United States Patent [19]

Kreeger

[11] Patent Number: 4,813,544

[45] Date of Patent: Mar. 21, 1989

[54] STACKABLE PIE TRAY

[75] Inventor: Elsmer W. Kreeger, Howell, Mich.

[73] Assignee: Pinckney Molded Plastics, Inc., Howell, Mich.

[21] Appl. No.: 33,834

[22] Filed: Apr. 3, 1987

[51] Int. Cl.[4] ..... B65D 21/02

[52] U.S. Cl. ..... 206/509; 206/562; 220/236; 211/71

[58] Field of Search ..... 206/509, 558, 510, 557, 206/511, 563, 562; 220/23.6, 23.8; 217/25.5, 26, 26.5; 211/71, 188

[56] References Cited

U.S. PATENT DOCUMENTS

| | | | |
|---|---|---|---|
| Re. 30,962 | 6/1982 | Bridges . | |
| 2,026,396 | 12/1935 | Meinecke | 206/562 |
| 2,815,129 | 12/1957 | Highwood | 206/510 |
| 3,191,796 | 6/1965 | Schwartz et al. . | |
| 3,442,378 | 5/1969 | Wolfe . | |
| 3,469,686 | 9/1969 | Gutsche et al. . | |
| 3,470,851 | 10/1969 | Cannon | 217/26.5 |
| 3,638,849 | 2/1972 | Goines . | |
| 3,675,815 | 7/1972 | Rehrig . | |
| 3,905,506 | 9/1975 | Florian . | |
| 3,955,704 | 5/1976 | Smith | 217/25.5 |
| 4,440,303 | 4/1984 | Seager . | |
| 4,618,069 | 10/1986 | Quong | 220/23.6 |

FOREIGN PATENT DOCUMENTS

| | | | |
|---|---|---|---|
| 2527170 | 11/1983 | France | 220/23.6 |
| 6500343 | 7/1966 | Netherlands | 220/23.6 |

*Primary Examiner*—George E. Lowrance
*Attorney, Agent, or Firm*—Basile and Hanlon

[57] ABSTRACT

A stackable tray for holding a plurality of pie pans includes four like interconnected side walls and a horizontal platform joined to the side walls approximately midway of the height of the sidewalls. The platform is provided with circular openings each dimensioned to suspend a pie pan within the opening by the engagement of the peripheral flange at the top of the pan with the platform around the periphery of the opening. Centrally located hand hold openings are formed in each side wall and upper and lower stiffening webs extend across the upper and lower surfaces of the platform between the openings.

4 Claims, 3 Drawing Sheets

STACKABLE PIE TRAY

BACKGROUND OF THE INVENTION

Commercial bakeries typically, in the delivery of pies to supermarkets or retail outlets, employ a relatively large rectangular rack or container having a plurality of shelves which may be slid into or out of the container. The shelves are provided with openings which receive the pie pans and are vertically spaced within the rack or container so that a minimum, but adequate clearance is provided between pies on adjacent shelves. The racks customarily are mounted on wheels so that they may be easily moved between the delivery truck and the store.

Racks of the type described are quite expensive, require the provision of some means for restraining them against movement within the delivery truck, and require the provision of a power lift on the truck if deliveries are to be made to establishments which do not have a loading dock. Further, the entire rack must make a round trip into each store even if the rack is partially empty or the particular delivery requires only some, but not all of the pies contained in the rack.

The present invention is especially directed to a one piece stackable tray of thermo-plastic material which may be inexpensively produced in large quantities in an injection molding machine. Each tray will hold several individual pies and the trays are designed in a manner such that they may be stably stacked, one upon the other with adequate clearance between the pies in adjacent trays.

SUMMARY OF THE INVENTION

A tray embodying the present invention is of one piece molded construction and formed with four like side walls integrally joined to each other. A horizontal platform is joined along its edges to each of the four side walls and extends between the side walls at a level approximately midway of the height of the side walls. Symmetrically located circular openings are formed in the platform each dimensioned to receive a pie pan and to suspend the pie pan within the opening with the pan supported by its peripheral rim flange upon the top surface of the platform. Upper and lower stiffening webs are integrally formed on the platform, the upper stiffening webs extending between the mid points of each pair of opposed side walls. Hand hold openings are formed in each side wall at a central location below the platform and the lower stiffening webs converge from the side wall at each side of each opening to merge into a single web in a generally Y shaped configuration.

The lower edge of each side wall is formed with a downwardly opening groove which will receive the upper edge of the sidewall of a like tray so that the trays may be stably stacked, one upon the other.

Other objects and features of the invention will become apparent by reference to the following specification and to the drawings.

IN THE DRAWINGS

Figure 1:
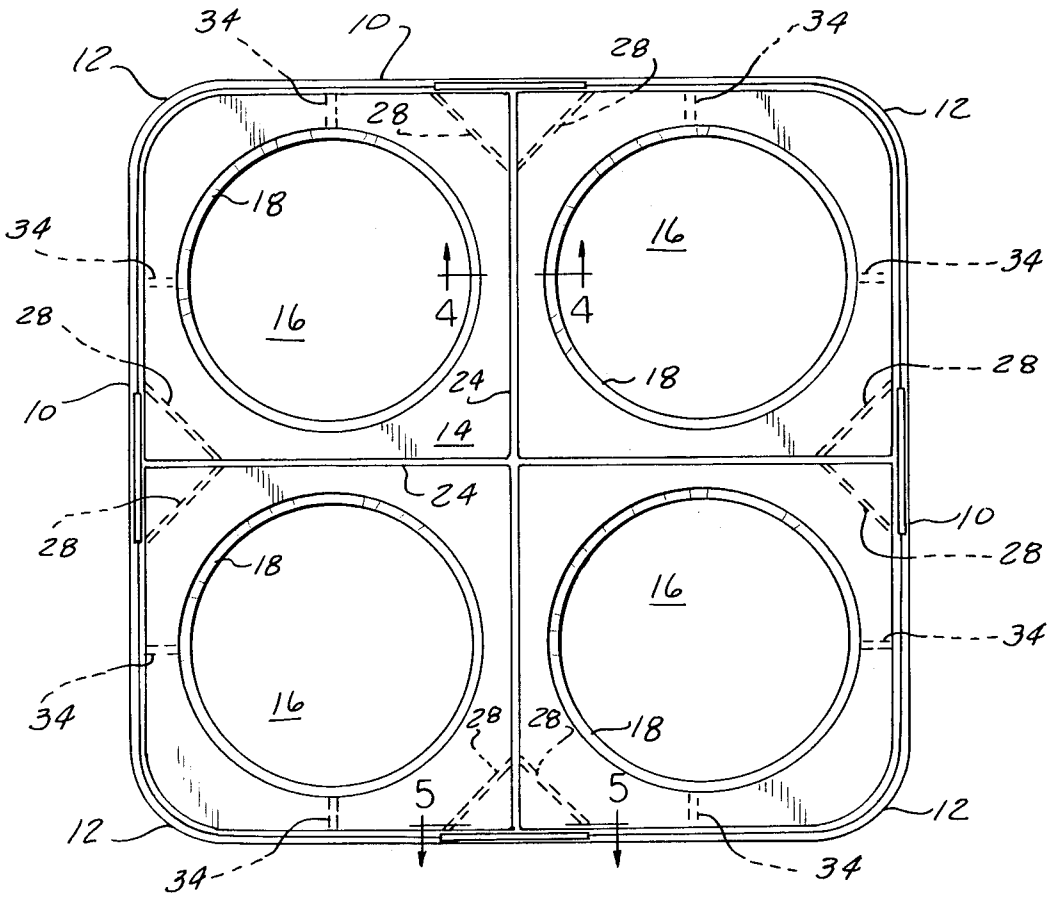
FIG. 1 is a top plan view of a tray embodying the present invention.
Figure 4:
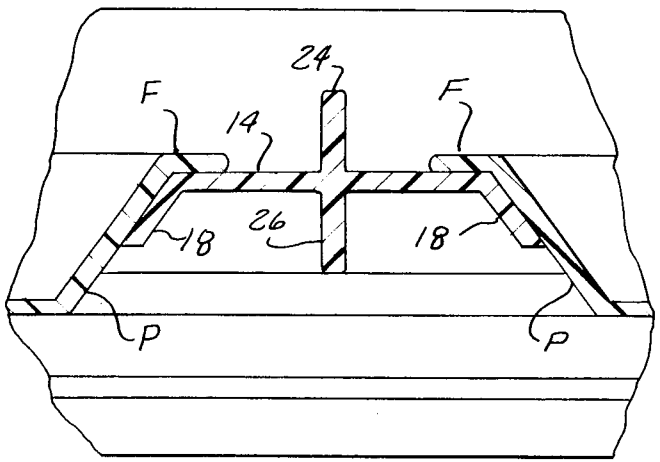
Figure 5:
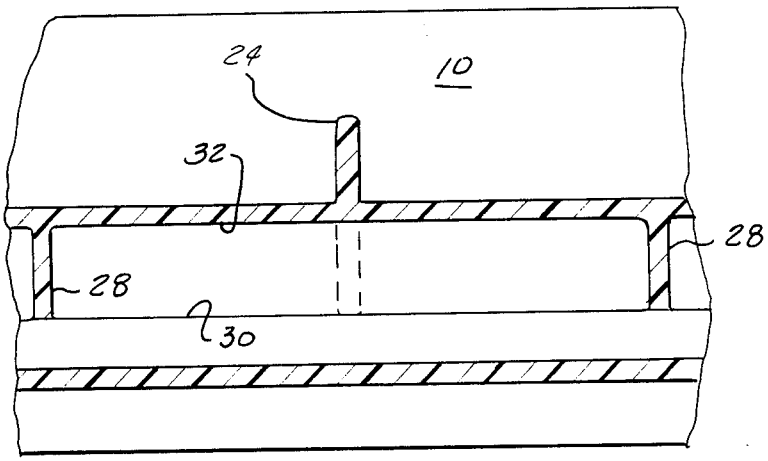

FIG. 4 is a detail cross-sectional view taken on line 4—4 of FIG. 1, showing portions of two pie pans received in the tray; and FIG. 5 is a cross-sectional view taken on like 5—5 of FIG. 1. Referring first to FIG. 1, there is shown a top plan view of a preferred embodiment of the invention in which the tray is of square configuration and designed to hold four pie pans. It will be appreciated that trays of different dimensions might well be employed, as for example, to hold six pies in two rows of three. However, the four pan tray illustrated represents a convenient size from the standpoint of manual handling and will carry four 9" pie pans within a tray having sides approximately 20" in length. The tray may be conformed to carry other sizes of pie pans.

The tray shown in the drawings is of one piece molded construction and formed from a suitable thermo-plastic material, such as polypropelene, for example, by a well known injection molding process.

Figure 3:
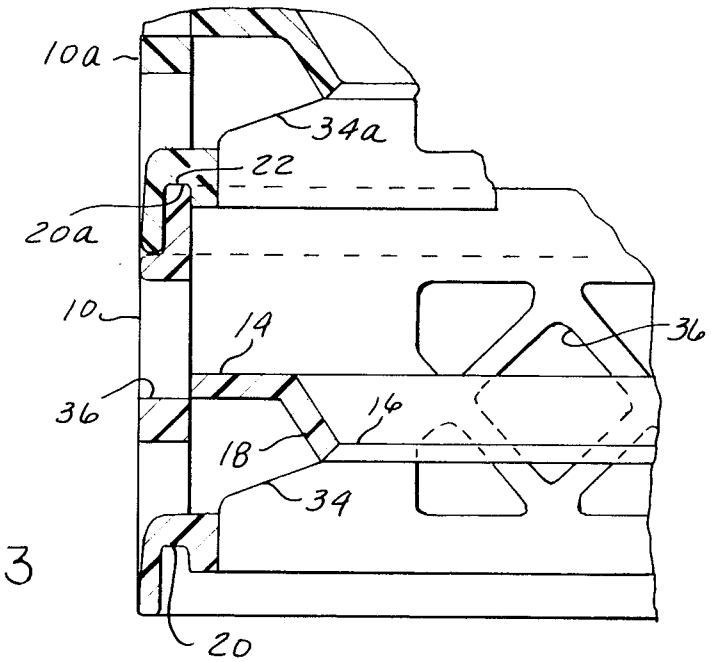
FIG. 3 is a detail cross-sectional view taken on line 3—3 of FIG. 2 and showing a portion of a corresponding cross-section of a second tray stacked upon the first.

The square tray shown in the drawings includes four like side walls 10 integrally joined to each other by rounded corner sections 12. A horizontal platform 14 is integrally joined along its edges to the inner sides of side walls 10 and corner sections 12 and is formed with four symmetrically located circular openings 16. As best seen in FIGS. 3 and 4, the edges of openings 16 are each defined by an inwardly and downwardly convergent frusto-conical lip or flange 18 whose dimensions and inclination are matched to the side walls of a particular size of pie pan P, see FIG. 4. The pie pan P may be suspended within the opening 16 by the engagement of its radially outwardly projecting rim flange F with the upper surface of platform 14 around the periphery of the opening and by the engagement of the side wall of the pan with the annular frusto-conical flange 18.

As best seen in FIG. 3, horizontal platform 14 is located approximately midway of the height of the side walls 10 of the tray to provide adequate clearance between a pie pan supported in one tray and the top of a pie contained in a pan in the next underlying tray when two trays are stacked on upon each other. The lower edges of all of the side walls and corner sections of each tray are formed with a downwardly opening stacking groove 20 which is conformed to receive the upper edge 22 of the side walls and corner sections of a like tray as best seen in FIG. 3. This enables the trays to be stacked one upon the other into a stable, interlocked stack.

Figure 2:
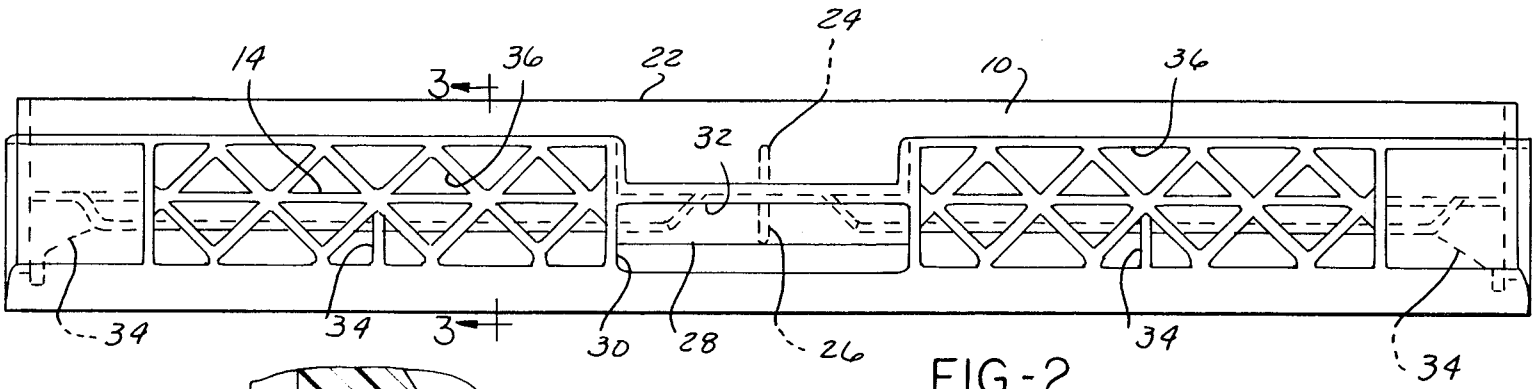
FIG. 2 is a side elevational view of the tray of FIG. 1.

To stiffen platform 14, vertically disposed upper 24 and lower 26 stiffening webs are integrally formed on the respective upper and lower surfaces of platform 14. Upper stiffening webs 24 are integrally joined to each of two opposed side walls 10 and extend entirely across the upper surface of platform 14 between the mid points of the respective side walls as best seen in FIG. 1. The central portions of lower stiffening webs 26 project downwardly from the underside of platform 14 in underlying relationship with upper stiffening webs 24, but split and diverge into outer web sections 28 in a generally Y shaped configuration to integrally join the respective side walls 10 along the side edges of a hand hold opening 30 best seen in FIGS. 2 and 5. The upper edge of opening 30 is adjacent the lower surface of platform 14. Suitably located gussets 34 (FIGS. 1, 2 and 3) may be provided to afford further support to platform 14.

The various side walls may, if desired, be formed with grid-like openings as at 36 to reduce the overall weight of the tray while maintaining adequate stiffness of the side walls.

Figure 6:
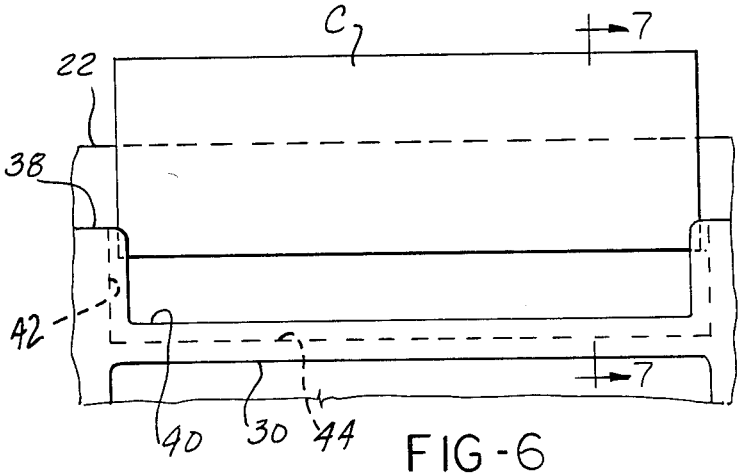
Figure 7:
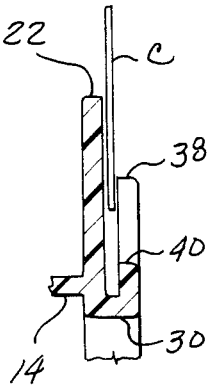

Side walls 10 are each formed on their outer side with an upwardly facing shoulder 38 which has a lowered central portion 40. Shoulder 38 is formed with undercut recesses 42, 44 (FIGS. 6 and 7) along the sides of central portion 40 to form a card receiving slot in each side wall for receiving a card C, shown partially inserted in FIGS. 6 and 7. Card C may be employed to identify the product carried by the tray, customer name, etc.

In FIG. 3, a partial cross-sectional view showing two like trays stacked upon each other is shown with the reference numerals identifying various parts of the uppermost tray followed by the subscript "a".

While one embodiment of the invention has been described in detail, it will be apparent to those skilled in the art the disclosed embodiment may be modified. Therefore, the foregoing description is to be considered exemplary, rather than limiting, and the true scope of the invention is that defined in the following claims.

I claim:

1. A stackable tray for holding a plurality of circular pie pans each haivng a radially outwardly projecting peripheral flange at its top, said tray comprising four generally rectangular side walls interconnected to each other in a generally square configuration, a generally square horizontal platform fixedly joined along its edges to said side walls and extending therebetween at a level approximately midway of the height of said side walls, means defining at least four symmetrically located circular openings through said platform, said openings being of a diameter such that a pie pan may be suspended within one of said openings by the engagement of its peripheral flange upon said platform around the periphery of the opening, stiffening web means integral with said platform extending across said platform between said openings from each side wall to the opposite side wall, means on each side wall defining a generally rectangular opening through each side wall midway between the opposite ends of the side wall, said opening having an upper edge adjacent the lower surface of said platform, said stiffening web means including lower stiffening web means integral with and projecting downwardly from the lower surface of said platform, said lower web means including outer web sections integrally joined to each side wall adjacent the opposite side edges of said opening and converging symmetrically from said opening to merge into a single web lying in a vertical general plane bisecting two opposed side walls of said tray, and cooperable stacking means on the top and bottom edges of said side walls for stably stacking like trays one upon another.

2. The invention defined in claim 1 wherein said stiffening web means further comprises upper stiffening web means integral with and projecting upwardly from the upper surface of said platform, said upper web means lying in vertical general planes bisecting opposed side walls of said tray.

3. The invention defined in claim 1 further comprising a frusto-conical annular flange integral with said platform and projecting downwardly therefrom around the periphery of each of said openings, said annular flange being complementary to the side wall of the pie pan.

4. The invention defined in claim 1 further comprising means on each side wall for releasably receiving a tray content identification card.

* * * * *